United States Patent [19]

Ushio et al.

[11] Patent Number: 4,856,462

[45] Date of Patent: Aug. 15, 1989

[54] CYLINDER BLOCK MADE OF FIBER-REINFORCED LIGHT ALLOY FOR INTERNAL COMBUSTION ENGINE

[75] Inventors: Hideaki Ushio; Tadayoshi Hayashi; Kazuo Shibata; Tsunehisa Hata; Yoshikazu Fujisawa, all of Saitama, Japan

[73] Assignee: Honda Giken Kogyo Kabushiki Kaisha, Tokyo, Japan

[21] Appl. No.: 119,873

[22] Filed: Nov. 13, 1987

[30] Foreign Application Priority Data

Nov. 13, 1986 [JP] Japan ..... 61-174660[U]
Nov. 13, 1986 [JP] Japan ..... 61-174661[U]
Nov. 13, 1986 [JP] Japan ..... 61-174662[U]

[51] Int. Cl.[4] ..... F02F 1/10

[52] U.S. Cl. ..... 123/41.84; 123/193 C; 123/41.74; 123/668

[58] Field of Search ..... 123/193 C, 41.84, 41.74, 123/668

[56] References Cited

U.S. PATENT DOCUMENTS 4,757,790 7/1988 Ushio et al. ..... 123/193 C

FOREIGN PATENT DOCUMENTS 3149775 6/1983 Fed. Rep. of Germany ..... 123/668
2183785 6/1987 United Kingdom .

*Primary Examiner*—E. Rollins Cross
*Attorney, Agent, or Firm*—Lyon & Lyon

[57] ABSTRACT

A cylinder block made of fiber-reinforced light alloy for an internal combustion engine comprises a cylinder barrel having a fiber-reinforced part formed around a cylinder bore, and a cylinder block outer wall surrounding the cylinder barrel and defining a water jacket between itself and the barrel, wherein a reinforcing deck part is provided to connect between the outer wall and an end portion of the barrel adjacent the cylinder head joining surface, the deck part having a thickness in the direction of barrel axis set to be not less than 7% of a piston stroke.

9 Claims, 7 Drawing Sheets

CYLINDER BLOCK MADE OF FIBER-REINFORCED LIGHT ALLOY FOR INTERNAL COMBUSTION ENGINE

BACKGROUND OF THE INVENTION

1. Field of the Invention

The present invention relates to a cylinder block made of fiber-reinforced light alloy for an internal combustion engine and more particularly to a cylinder block having a cylinder barrel with its portion around a cylinder bore formed by a fiber-reinforced part and a cylinder block outer wall surrounding the cylinder barrel and defining therebetween a water jacket.

2. Description of the Prior Art

There has been conventionally known a light alloy-made cylinder block for use with an internal combustion engine, which is cast therein with a cylinder sleeve made of cast iron (see U.S. Pat. No. 3,561,104).

If it is desired to further reduce the weight of a cylinder block obtained in accordance with the above prior art, a possible measure may be to reinforce the part of the cylinder block around its cylinder bore by fibers instead of using the cast iron-made cylinder sleeve.

If in this case a so-called open deck type design is employed for the cylinder block which has its water jacket opened at the cylinder head end portion thereof due to the use of a light alloy matrix having a low Young's modulus, that portion of the cylinder barrel which is located adjacent the cylinder head joining surface of the barrel shows a tendency to be deformed and enlarged in bore diameter when said portion is subjected to combustion gas pressure. This may disadvantageously result in an increase in the amount of blowby gas and of oil consumption.

Further, if the fiber-reinforced part is formed to have a large thickness in the radial direction of the cylinder bore with a view to improving the strength while keeping such thickness uniform over the entire length of the cylinder bore, there also will be a deterioration in the heat radiation property of the fiber-reinforced part at its portion adjacent the cylinder head joining surface which may result in a high temperature in that portion during engine operation.

Moreover, in a cylinder block for a multi-cylinder type internal combustion engine, when fiber-reinforced parts for respective cylinders are formed independently from each other, the respective fiber-reinforced parts contribute very little to the rigidity of the whole cylinder block although they have a relatively high rigidity in themselves by reason of the reinforcing fibers contained therein.

SUMMARY OF THE INVENTION

The present invention aims at providing a cylinder block of the afore-mentioned type which could solve the above problems through the measure of including reinforcement to the cylinder barrel at its portion near the cylinder head joining surface.

Another object of the invention is to provide a cylinder block of the mentioned type which is superior in wear resistance and has a high strength as well as a high heat radiation property.

Further object of the invention is to provide a cylinder block of the type mentioned above which is usable in a multi-cylinder type internal combustion engine and has a rigidity greatly enhanced by utilizing respective fiber-reinforced parts of the cylinders.

In order to achieve the above objects, according to the present invention, there is proposed a cylinder block made of fiber-reinforced light alloy for use with an internal combustion engine, which comprises a cylinder barrel having a portion thereof around a cylinder bore formed as a fiber-reinforced part, and a cylinder block outer wall surrounding the cylinder barrel and defining therebetween a water jacket, wherein a reinforcing deck part is provided connecting between the cylinder block outer wall and that end portion of the cylinder barrel having the cylinder head joining surface, said reinforcing deck part having its thickness in the axial direction of the cylinder barrel determined to be at a level of 7% or more of the piston stroke.

Further according to the invention, a cylinder block is proposed and provided with a fiber-reinforced part having a wall thickness thereof in the radial direction of the cylinder bore reduced gradually from its one end portion on the side of a crankcase toward its opposite end portion on the side of the cylinder head joining surface.

Still further according to the invention, there is proposed a cylinder block having a plurality of fiber-reinforced parts, of which adjacent fiber-reinforced parts are integrally connected via fiber-reinforced inter-connecting parts.

Still further, by providing a reinforcing deck part having the above structure, such combustion gas pressure can be transmitted to and supported by the cylinder block outer wall via the reinforcing deck part. Hence, undesirable enlargement in bore diameter and deformation at the portion of the cylinder barrel near the cylinder head joining surface can be suppressed thereby to reduce the amount of blowby gas and oil consumption greatly.

Also with the above arrangement, since the fiber-reinforced part around the cylinder bore is formed to have a small wall thickness in the radial direction of the bore at a portion thereof adjacent the cylinder head joining surface, a good heat radiation is assured at said joining surface-adjacent portion which reaches quite a high temperature during operation of the engine. Moreover, since the cylinder bore surrounding portion is wholly reinforced with fibers, the inner peripheral surface of the bore can exhibit an excellent wear resistance and strength. It should be noted here that formation of the fiber-reinforced part to have a gradually reduced thickness as mentioned above makes the provision of notch effects unnecessary at the cylinder bore surrounding portion and this is very advisable in order to achieve an improvement in strength.

Furthermore, to connect adjacent ones of a plurality of fiber-reinforced parts by fiber-reinforced inter-connecting parts results in all the fiber-reinforced parts being integrated into a single rigid member. This rigid member can serve as a stiffener for the cylinder block thus permitting the cylinder block to have a largely enhanced rigidity.

The above and other objects, features and advantages of the invention will be apparent from the following detailed description of some preferred embodiments made in conjunction with the accompanying drawings.

BRIEF DESCRIPTION OF THE DRAWINGS

In the accompanying drawings,

FIGS. 1–4 show a first embodiment according to the invention wherein FIG. 1 is a plan view of a cylinder block, FIG. 2 is a sectional view taken along the line II—II in FIG. 1, FIG. 3 is a sectional view taken along the line III—III in FIG. 2 and FIG. 4 is a perspective view of a cylindrical shaped fiber article;

FIGS. 5 and 6 show a second embodiment wherein FIG. 5 is a sectional view similar to FIG. 2 and FIG. 6 is a front view of another cylindrical shaped fiber article with a portion cut away; and FIGS. 7–12 show a third embodiment wherein FIG. 7 is a sectional view similar to FIG. 2, FIG. 8 is a sectional view taken along the line VIII—VIII of FIG. 7, FIGS. 9 and 10 show an example of connection between cylindrical shaped fiber articles, FIG. 9 being a front view thereof and FIG. 10 being a section taken along the line X—X in FIG. 9, and FIGS. 11 and 12 show another example of connection between cylindrical shaped fiber articles, FIG. 11 being a front view thereof and FIG. 12 being a section taken along the line XII—XII in FIG. 11.

DESCRIPTION OF THE PREFERRED EMBODIMENTS

Figure 1:
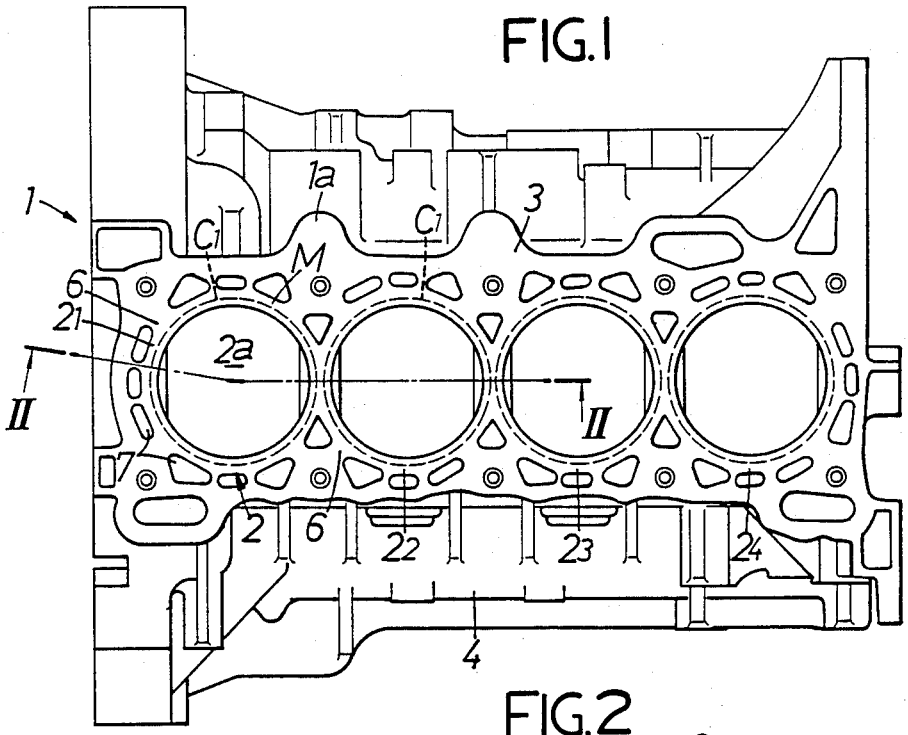
Figure 2:
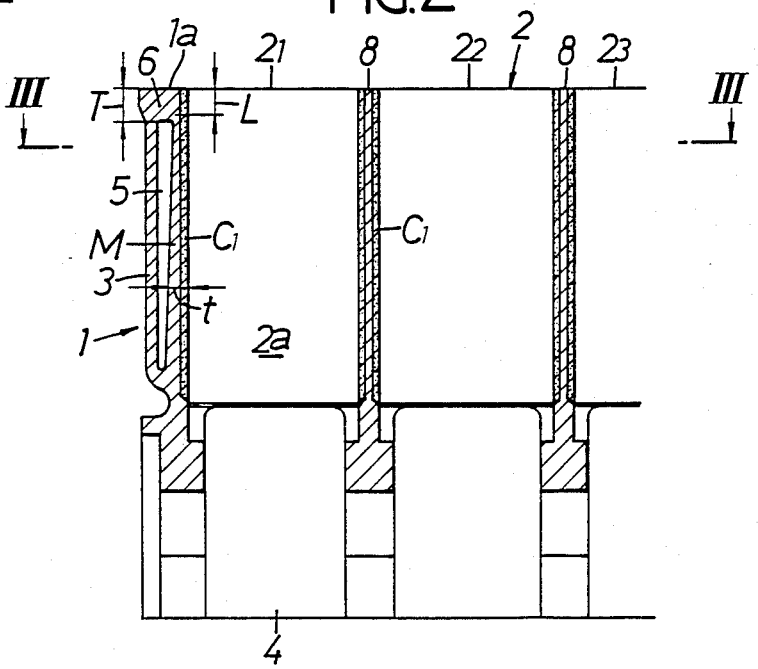
Figure 3:
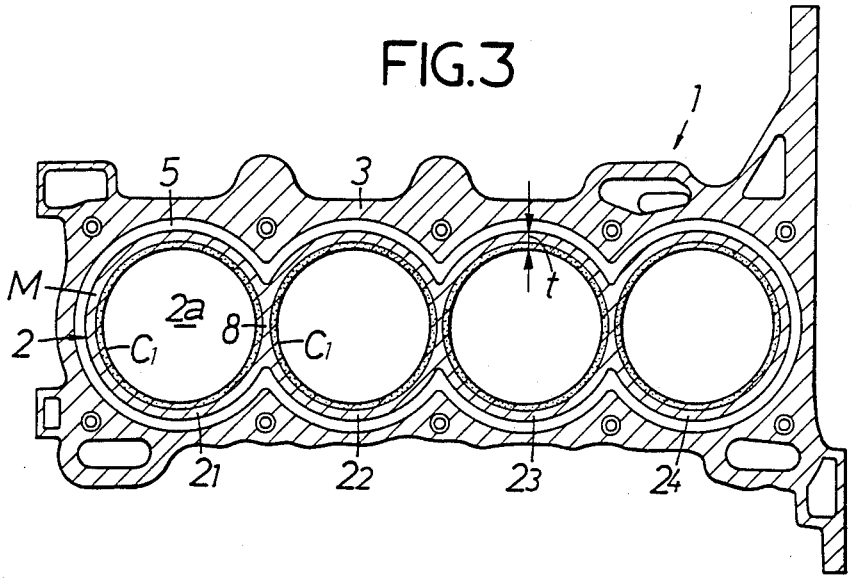

FIGS. 1–4 show a first embodiment according to the invention. In FIGS. 1–3, a siamese type cylinder block 1 is formed by casting from a light alloy material such as aluminum alloy and includes a siamese cylinder barrel having a plurality of, four in the illustrated example, cylinder barrels $2_1$–$2_4$ connected with each other, the barrels each having a bore 2*a* therein; a cylinder block outer wall 3 surrounding the siamese cylinder barrel; and a crankcase 4 formed continuously with the outer wall 3, wherein between the siamese cylinder barrel 2 and the cylinder block outer wall 3 is defined a water jacket 5 to which the outer periphery of the cylinder barrel 2 is exposed. The cylinder block 1 has a cylinder head joining surface 1*a* and, at one end portion of the water jacket 5 having the cylinder head joining surface 1*a* the siamese cylinder barrel 2 and the cylinder block outer wall 3 are connected together locally through a plurality of reinforcing deck parts 6. Portions of the water jacket 5 located between adjacent deck parts serve as communication ports 7 leading to the cylinder head side. Thus, the cylinder block 1 is constituted into a closed-deck type.

Figure 4:
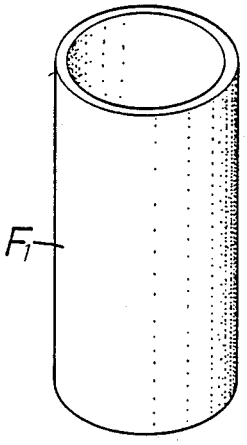

Each of cylinder barrels $2_1$–$2_4$ comprises a cylindrical fiber-reinforced part $C_1$ providing a fiber reinforcement around the cylinder bore 2*a* and a cylindrical light alloy-only part M. The fiber-reinforced part $C_1$ is made up of a cylindrical shaped fiber article $F_1$ shaped from reinforcing fibers as shown in FIG. 4 and a light alloy matrix filled into the fiber article. As reinforcing fibers for this purpose, long fibers, short fibers and whiskers formed of such as ceramic are employed with a view to improving the sliding property and strength and may include alumina fibers such as Saffil (trade name) of ICI, Fiber FP (trade name) of Du Pont and the like, for example. Further, carbon fibers such as Toreca T300 (tradename) of TORAY may be mixed therewith.

It has been found that the respective cylinder barrels $2_1$–$2_4$ are exposed to a severe combustion gas pressure at areas thereof which extend from their uppermost end at the cylinder head joining surface 1*a* down to a point distanced therefrom by 7% in length of the piston stroke S, that is, indicated by reference character L in FIG. 2.

In view of this, the thickness T of each reinforcing deck part 6 measured in the axial direction of the cylinder barrel is proposed to be set not less then 7% of the piston stroke S, i.e., $T \geqq 0.07$ S.

Owing to the afore-mentioned arrangement having a plurality of reinforcing deck parts 6 provided and designed to be of the specific thickness T, it is possible to let the combustion gas pressure be supported by the cylinder block outer wall 3 through the respective reinforcing deck parts 6. As a result, undesirable deformation and enlargement in diameter of the portions of respective cylinder barrels $2_1$–$2_4$ in the vicinity of the cylinder head joining surface 1*a* can be suppressed, contributing to a large reduction in blowby gas and oil consumption.

Appropriately, said thickness T of the reinforcing deck parts 6 may be as a permissible maximum value not more than 20% of the piston stroke S, that is, $T \geqq 0.2S$. In other words, it can be described that the areas of respective cylinder barrels $2_1$–$2_4$ which are affected by the severe combustion gas pressure correspond in the phase of rotation of a crankshaft to the range from the top dead center to a point advanced by about 30 degrees. Calculating out from this range of rotational phase provides as the thickness T the value of not more than 20% of the piston stroke S as explained above. If the reinforcing deck part 6 is given a thickness exceeding the above determined value T, it may undesirably give rise to an increase in weight and a deteriorated cooling effect obtainable at the cylinder barrels $2_1$–$2_4$.

Also in the case of providing water communication holes through inter-connecting parts 8 connecting between adjacent cylinder barrels $2_1$ and $2_2$; $2_2$ and $2_3$; and $2_3$ and $2_4$ for the purpose of improving the cooling characteristic thereof, it may be advantageous to set the thickness of the parts 8 between the cylinder head joining surface 1*a* and those water communication holes at the same level as the afore-mentioned thickness T.

Wall thickness t of the respective cylinder barrels $2_1$–$2_4$ at parts thereof other than the inter-connecting parts 8 gradually decreases from one end portion at the crankcase 4 toward their opposite end portion at the cylinder head joining surface 1*a*.

With this arrangement, the parts of the barrels $2_1$–$2_4$ which are heated to a higher temperature during engine operation have a thinner wall thickness t, so that an effective cooling by the water jacket 5 is given to the barrels. This makes uniform the amount of radial expansion by heat of each cylinder barrel $2_1$–$2_4$ over the axial length thereof, which can further enhance the effect of reducing the blowby gas amount and other disadvantages.

One example will be explained in the following with respect to the production of a cylinder block 1 of the mentioned type.

Explanation will first be made as to how the cylindrical shaped fiber article $F_1$ may be produced. Alumina fibers having a diameter of 3–6 μm and carbon fibers with a diameter of 6–10 μm are mixed together at a volume ratio of 3:1 and then an organic binder or an inorganic binder such as alumina sol and silica sol is added to the mixture to achieve a predetermined material for molding. The achieved material is subject to a suction molding and is shaped into a cylindrical member which is then heated and dried in case of using an organic binder or is heated, dried and thereafter baked in case of employing an inorganic binder, thereby providing the cylindrical shaped fiber article $F_1$ having a fiber volume fraction of 20 to 30%.

In a casting process, a mold is previously heated to a temperature of 100°–120° C. and respective cylindrical shaped fiber articles $F_1$ are previously heated up to a temperature of about 300° C. The shaped fiber articles $F_1$ and a sand core for forming a water jacket are placed in the mold. Then a melt of aluminum alloy (Al—Si—Cu) at a temperature of 730°–740° C. is poured into the mold and is completely solidified under the application of a pressure ranging from 200 to 300 kg/cm$^2$.

Cylinder blocks according to the present invention include one which is obtained by casting a fiber-reinforced composite tubular product consisting of a cylindrical shaped fiber article and a light alloy matrix.

Figure 5:
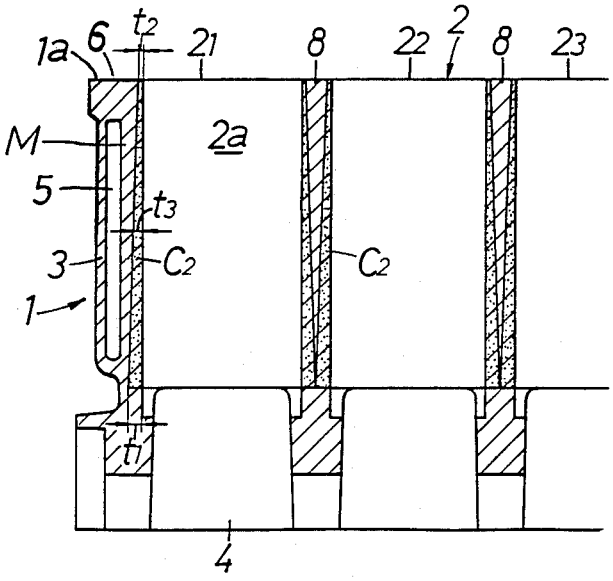
Figure 6:
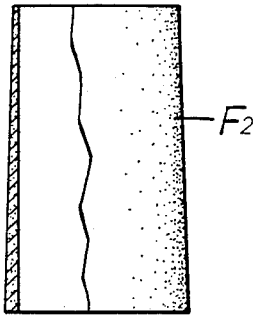
Figure 7:
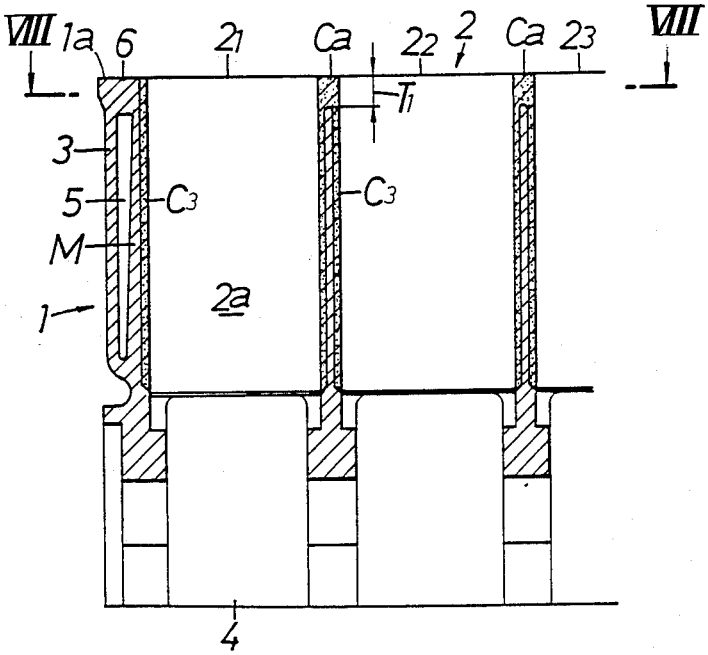
Figure 8:
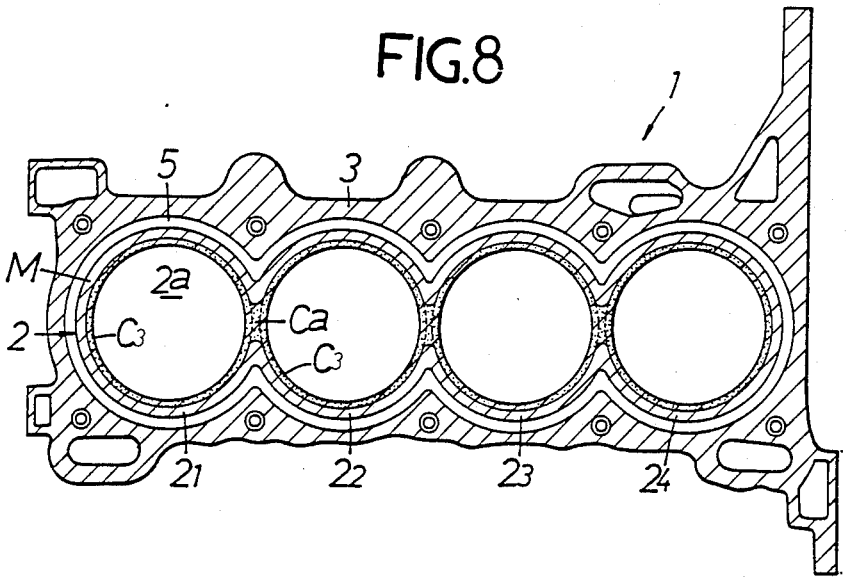
Figure 9:
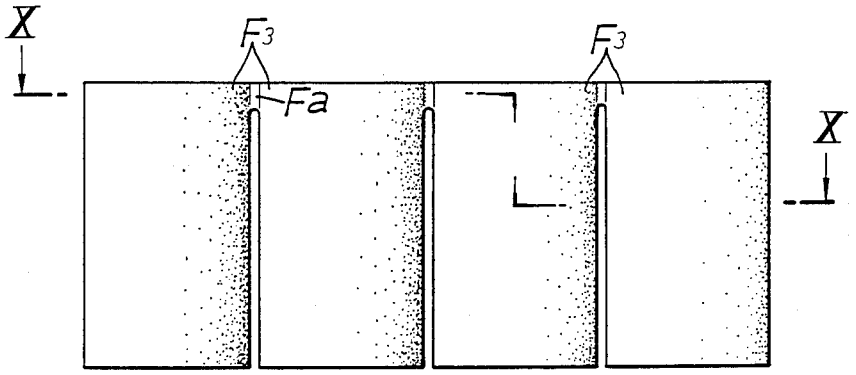
Figure 10:
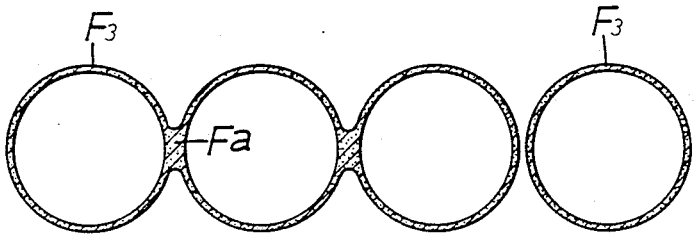

FIGS. 5 and 6 show a second embodiment. As will be apparent from FIG. 6, a tubular shaped fiber article $F_2$ is shaped by using the above-described fibers and has a wall thickness gradually reduced from its crankcase 4 end portion toward the cylinder head joining surface 1*a* end portion. Accordingly, the wall thickness of the fiber-reinforced part $C_2$ in the radial direction of the cylinder bore becomes largest at its crankcase 4 end portion as shown by $t_1$ whereas it becomes smallest at the cylinder head joining surface 1*a* end portion thereof shown by $t_2$. Moreover, the intermediate portion of the fiber-reinforced part extending between those opposite end portions shows a thickness $t_3$ gradually decreasing from the crankcase 4 end toward the joining surface 1*a*.

In the above construction, the fiber-reinforced part $C_2$ defining the cylinder bore 2*a* therein has a thinner wall in the vicinity of the cylinder head joining surface 1*a*, whereby the thin wall portion near the surface 1*a*, which is heated up to a high temperature during engine operation, can exhibit a good radiation of heat.

Since the siamese type cylinder block 1 is intended to gain a compactness in size by connecting the adjacent cylinder barrels $2_1$ and $2_2$; $2_2$ and $2_3$; and $2_3$ and $2_4$ together through inter-connecting parts 8 and with their cylinder bores 2*a* being placed as close to each other as possible, when the engine is operated, each inter-connecting part 8 shows a noticeable temperature rise at its portion near the cylinder head joining surface 1*a* and additionally such portion is difficult to cool by the water jacket 5. However, such problematic respects can be eliminated by assuring a high heat radiation property to the said portion in the above-mentioned manner.

Moreover, the part defining the cylinder bore 2*a* is wholly reinforced with fiber so that the inner peripheral surface of the bore 2*a* can exhibit excellent wear resistance and strength. It should be noted here that the gradually decreased thickness of the fiber-reinforced part $C_2$ enables the part surrounding the cylinder bore 2*a* to be devoid of formation of notch effect, which is very effective for improving the strength thereof.

In order to substantially equalize the strength around the cylinder bore 2*a* along its axial direction, it may be advantageous to increase in a gradual manner the fiber volume fraction of the fiber-reinforced part $C_1$ from the crankcase 4 end portion thereof toward the opposite end portion on the joining surface 1*a* side.

Namely, assuming that the fiber volume fractions at one end portion of the crankcase 4, the other end portion at the cylinder head joining surface 1*a* and the intermediate portion between the end portions are $Vf_1$, $Vf_2$ and $Vf_3$, respectively, it is arranged to satisfy the following equation:

$$Vf_1 \cdot t_1 = Vf_2 \cdot t_2 = Vf_3 \cdot t_3$$

Due to the above arrangment, not only the portion surrounding the cylinder bore 2*a* can be equalized in strength but also the wear resistance and strength of the fiber-reinforced part C2 at its portion near the cylinder head joining surface 1*a* is enhanced. These advantages are derived from the specific structure of that portion adjacent the joining surface 1*a* having a high fiber volume fraction in spite of its thin thickness and also being of a nature to enable a reliable filling of light alloy material into said adjacent portion owing to the thin thickness even with the high fiber volume fraction.

FIGS. 7–12 illustrate a third embodiment. As clearly shown in FIGS. 9 and 10, the peripheral walls of adjacently located cylindrical shaped fiber articles $F_3$ are connected together at one end portions thereof leading to the cylinder head joining surface 1*a* and their adjacent portions via connecting members Fa which are formed of reinforcing fibers of the same material as those constituting the articles $F_3$. As a consequence, adjacent fiber-reinforced parts $C_3$ are connected with each other at one end portion adjacent to the cylinder head joining surface 1*a* via fiber-reinforced interconnecting parts Ca which are constituted by the aforementioned connecting members Fa and a light alloy matrix filled into the members.

This results in forming a single rigid body from all the fiber-reinforced parts $C_3$. The obtained rigid body serves as a stiffener for the cylinder block 1 to enhance the rigidity of the cylinder block 1.

Furthermore, since each fiber-reinforced part $C_3$ is reinforced by its adjacent fiber-reinforced parts $C_3$ at that portion thereof adjacent the cylinder head joining surface 1*a*, which is exposed to a high combustion gas pressure, via the fiber-reinforced inter-connecting parts Ca, it is possible to suppress deformation and enlargement in diameter of the respective fiber-reinforced parts $C_3$ which may be caused by the combustion gas pressure, thus leading to a reduction in the amount of blowby gas and oil consumption. In addition, following an enhanced rigidity at the cylinder head joining surface 1*a* achieved by the fiber-reinforced parts $C_3$ and fiber-reinforced inter-connecting parts Ca, it is possible to increase the surface pressure which is required at the time of assembling of a cylinder head thereto, whereby any leakage of combustion gas between the cylinder head joining surface 1*a* and a gasket and resultant generation of noise can be prevented. Also, the respective fiber-reinforced inter-connecting parts Ca serve to enhance the heat resistance at portions located between adjacent cylinder barrels $2_1$–$2_4$.

It is noted that on the inner periphery of a cylinder bore, a severe combustion gas pressure acts on that area thereof extending to a point distanced by 15% in length of the piston stroke S, that is, 0.15S, from the cylinder head joining surface 1*a*. Therefore, it is preferable to set the thickness $T_1$ of the fiber-reinforced part $C_3$ at said fiber-reinforced inter-connecting part Ca in the axial direction of the bore so as to have a relationship of $T_1 \geqq 0.15S$.

There is also an advantage in constructing the plurality of cylindrical shaped fiber articles $F_3$ into a single member so that those plural fiber articles can be placed in a mold cavity by one step at the time of casting the cylinder block 1.

Figure 11:
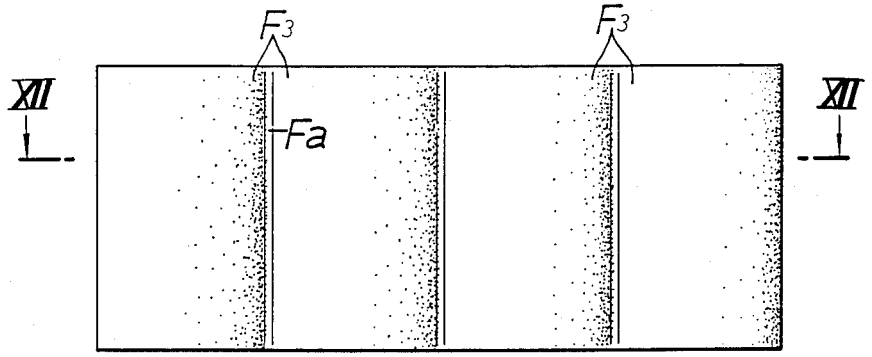
Figure 12:
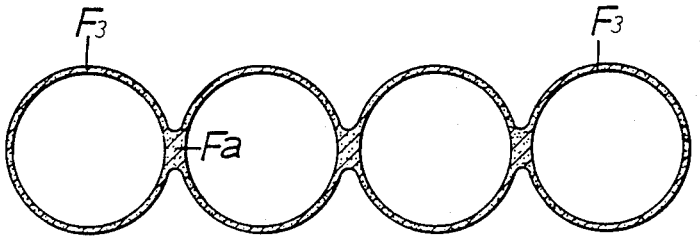

FIGS. 11 and 12 show a modified form of a unitarized structure of cylindrical shaped fiber articles $F_3$ wherein adjacent articles are connected together at peripheral wall portions thereof along the entire length in the direction of their generating lines by the use of interconnecting parts Fa, thus obtaining a siamese configuration.

With an arrangement thus constructed, the strength of each cylindrical shaped fiber article $F_3$ is improved in addition to the above-described features and advantages so that its handling can be made easier. This markedly facilitates mounting of the cylindrical shaped fiber articles $F_3$ into the mold when casting a cylinder block 1.

While the invention has been applied to a cylinder block for a four-cylinder type internal combustion engine in the foregoing description of some embodiments, it can of course be applied to other types of cylinder blocks, for example, for a two-cylinder type engine.

What is claimed is:

1. A cylinder block made of fiber-reinforced light alloy for an internal combustion engine, comprising a cylinder barrel having a fiber-reinforced part formed around a cylinder bore, and a cylinder block outer wall surrounding said cylinder barrel and defining a water jacket between the cylinder barrel and the outer wall, wherein a reinforcing deck part is provided to connect between said cylinder block outer wall and an end portion of said cylinder barrel adjacent a cylinder head joining surface, said reinforcing deck part having a thickness in an axial direction of the cylinder barrel set to be not less than 7% of a piston stroke.

2. A cylinder block according to claim 1, wherein said thickness of the reinforcing deck part is set to be not more than 20% of the piston stroke.

3. A cylinder block according to claim 1, wherein said cylinder barrel has a wall thickness decreased gradually from one end portion thereof near a crankcase toward the other end portion near the cylinder head joining surface.

4. A cylinder block according to claim 1, 2 or 3, wherein said fiber-reinforced part has a wall thickness, measured in a radial direction of the cylinder bore, set to be decreased gradually from one end portion near a crankcase toward the other end portion near the cylinder head joining surface.

5. A cylinder block according to claim 1, 2 or 3, wherein said fiber-reinforced part has a fiber volume fraction set so as to be increased gradually from one end portion thereof near a crankcase toward the other end portion near the cylinder head joining surface.

6. A cylinder block according to claim 1, 2 or 3, wherein said fiber-reinforced part is provided in a plurality of cylinder barrels and adjacent ones of the fiber-reinforced parts are connected with each other through fiber-reinforced inter-connecting parts.

7. A cylinder block according to claim 6, wherein said fiber-reinforced inter-connecting parts are disposed adjacent the cylinder head joining surface.

8. A cylinder block according to claim 6, wherein said fiber-reinforced enter-connecting parts extend for the entire length of adjacent portions of the fiber-reinforced parts.

9. A cylinder block according to claim 4, wherein said fiber-reinforced part has a fiber volume fraction set so as to be increased gradually from one end portion thereof near a crankcase toward the other end portion near the cylinder head joining surface.

* * * * *